US006155454A

United States Patent [19]

George et al.

[11] Patent Number: 6,155,454

[45] Date of Patent: Dec. 5, 2000

[54] PILL DISPENSER EMPLOYING A SEALED PILL CARRIER AND INTEGRATED DISPENSING PLUNGERS

[75] Inventors: Donald C. George, 4621 Via Gennita, Santa Barbara, Calif. 93111; Dean T. Upton, Santa Barbara, Calif.

[73] Assignee: Donald C. George, Santa Barbara, Calif.

[21] Appl. No.: 09/126,232

[22] Filed: Jul. 30, 1998

Related U.S. Application Data

[63] Continuation-in-part of application No. 08/850,578, May 3, 1997.

[51] Int. Cl.[7] ..... G07F 11/66

[52] U.S. Cl. ..... 221/25; 206/531

[58] Field of Search ..... 221/25, 26, 31, 221/30, 185; 206/528, 531, 532, 535

[56] References Cited

U.S. PATENT DOCUMENTS 4,733,797 3/1988 Haber ..... 221/25

5,019,125 5/1991 Rebne et al. ..... 206/531

*Primary Examiner*—Kenneth W. Noland

*Attorney, Agent, or Firm*—Lyon, Harr & DeFrank; Richard T. Lyon

[57] ABSTRACT

A first embodiment of a pill dispenser includes a pill carrier and dispenser housing. The pill carrier has a plurality of pill chambers, each of which initially holds a pill that is sealed from the outside environment by a pair of membranes. The dispenser housing has a pill carrier slot into which the pill carrier is disposed and an opening forming a pathway from the slot to the exterior of the housing. In addition, the dispenser housing has an integrated plunger disposed adjacent the slot and opposite the opening. This plunger has a projecting punch head capable of extending into a pill chamber to push a pill out of dispenser housing opening whenever the plunger is depressed by a user. The pill chamber is first placed in alignment with the punch head and housing opening by displacing the pill carrier within the pill carrier slot. An indexing mechanism is preferably used to ensure the necessary alignment. In a second embodiment of the pill dispenser, there are a plurality of integrated plungers, each of which forms a top covering of a respective one of the pill chambers. These plungers are capable of dispensing a pill contained within its associated pill chamber. In operation, the pill carrier is drawn out of the pill carrier slot to sequentially exposure of each of the pill chambers and allow the user to dispense a pill by actuating its associated plunger.

48 Claims, 5 Drawing Sheets

PILL DISPENSER EMPLOYING A SEALED PILL CARRIER AND INTEGRATED DISPENSING PLUNGERS

RELATED APPLICATIONS

This application is a continuation-in-part of U.S. patent application Ser. No. 08/850,578 filed May 3, 1997 entitled PILL DISPENSER EMPLOYING A SEALED PILL CARRIER by Donald C. George et al.

BACKGROUND

1. Technical Field

This invention relates to an apparatus for dispensing medication, such as tablets, pills, capsules and the like, and particularly to such an apparatus which protects the medication from degrading influences while at the same time allowing the medication to be carried with a person at all times.

2. Background Art

Medication in solid form such as tablets, pills, capsules or the like (hereinafter collectively referred to as pills) must sometimes be carried with a person at all times. For example, a person who has angina pectoris needs to carry nitroglycerin pills in the case of an angina attack. The angina sufferer must immediately take a nitroglycerin pill orally when an attack occurs, and may need to take additional pills if the first is not successful in quelling the attack. Further, although not related to a condition causing an incapacitating attack, many people carry medication with them which must be taken regularly for convenience sake. For example, a person who must take regular doses of an antibiotic medication (in pill form) throughout the day to combat an infection would find it convenient to carry the medication in the car, to work, and other places away from home. Recently, a pill form of insulin has been introduced allowing a diabetic person to take pills throughout the day to control the disease. Thus, it will be convenient, if not necessary, for such a person to carry these insulin pills with them at all times. Allergy sufferers also tend to carry antihistamine and decongestant medications with them where ever they go. In addition, efforts are under way to create a pill form of epinephrine which could be used by persons susceptible to incapacitating, even life threatening, allergic reactions. Clearly, if such pills become available, they will be carried with the user at a all times. These are just a few of many instances where persons who must take medication regularly during a day would find it advantageous to carry it with them.

Typically, those carrying medicine in the form of pills on their person simply keep these medications in their original containers. This practice, however, has drawbacks. The original containers, such as conventional plastic pill bottles, are bulky and are not easily carried in one's pockets. In addition, to gain access to the medicine, a person must first remove the cap of the container and then single out a pill for ingestion. This task can be very difficult if the person requiring the medicine has trembling or shaking hands or the container has a child-proof cap. There may also be a cotton plug inside the container which must be removed before gaining access to the medication. Additionally, the need for the medication may occur at night or while the victim is driving, or poor eyesight may make it particularly difficult for him or her to single out a pill for ingestion. Further, once the cap has been removed, the pills could be easily spilled and the user may not be able to find them in time to prevent harm, or alternately the medication could become contaminated and useless.

Sometimes, medication is transferred to small containers designed to allow a person to carry a few pills with them more conveniently than employing the original pill bottle. For example, nitroglycerin tablets are often carried in a small tube with an inside diameter just larger than the pills themselves. Usually five to seven pills are stacked one on top of another in this tube. Unfortunately, these containers are known to fail such as when the cap which seals the tube becomes cross-threaded and stuck thereby making it difficult to remove. The pills can also be crushed by the cap if too many are loaded within the dispenser, and if space is left to avoid this problem, vibration of the pills increases. Vibration has been known to powderize the nitroglycerin pills to the point where they become jammed within the tube and cannot be extracted. Additionally, when the pills become pulverized the dosage is then uncertain. Another problem with these tube dispensers is that like the larger containers, the pills stacked within the tube can be easily spilled. This is especially true when the user is incapacitated in some way. The dispenser is also difficult to load, especially for someone with poor sight or impaired dexterity, because the containers are very small. It is also often difficult to ascertain the number of pills in the container, or whether they are stacked properly.

Some of the same problems also manifest themselves in other commercially available pill containers. For example, so-called pill organizers are available. These organizers typically include multiple pill compartments each having a re-closeable hinged lid. One or more pills are placed into each compartment and the lid is closed. The lid is subsequently snapped open to gain access to the pill(s). Although such containers provide a convenient way to store and organize pills, they are not well suited for protecting the pills contained therein from the rigors of being carried around by the user. For instance, the person carrying the pills may be walking, running, or exercising, thereby subjecting the pills to shock and vibration as they bounce around inside the container. The resulting shock and vibration can cause the pills to break up or powderize. Nitroglycerin is especially susceptible to degradation due to shock and vibration. These pills are very soft, having a consistency similar to compacted powdered sugar, and are easily pulverized if allowed to bounce around inside a container.

In addition to vibration and shock, the above-described pill containers also do not adequately protect the pills from other environmental factors which can degrade the medication. Moisture, high humidity, high temperatures, and even light can degrade some medications. The aforementioned pill bottles and organizers are not designed to seal or insulate the pills within, and so the pills can be affected by the aforementioned environmental factors. It is easy to imagine that such conditions could be encountered as the pills are carried outdoors, through industrial processing areas, and the like by the user. Even the aforementioned specially designed pill containers do not provide complete protection. Although the pills may be sealed once they are closed within these specially designed containers, they must be placed into the container and removed therefrom for ingestion. The mere fact that the pills have to be handled can degrade some medications. For example, nitroglycerin can be adversely affected by the moisture on one's hands when they are handled during loading or unloading of the pill container.

Pills are sometimes packaged in so-called soft or blister packs. These packs typically have multiple compartments, each of which contains a single dose of medication which is sealed within the compartment. Thus, the pills are protected against moisture and high humidity conditions. An individual compartment can be opened exclusive of the rest to obtained access to the pill held inside. Typically, this involves peeling back a covering forming a part of the pill compartment or pushing the pill through a frangible wall of the compartment. A blister pack permits the handling of a single dose of medication at a time, and minimizes the risk of contamination of the remaining pills. In addition, these blister packs are pre-packaged by the pill manufacturer and so there is no handling required by the user to load the pills as with the aforementioned pill containers.

It is well known to place blister packs into pill dispensers which house the pack and allow the pills to be extracted. These dispensers often have devices to assist in extracting the pill from a compartment of the pack. Typically, this involves some sort of plunger which pushes on the top of the compartment so as to push the pill through a frangible bottom covering. However, heretofore the intent behind such dispensers has been simply to facilitate extraction of the pill, rather than to protect the pills from the environmental hazard that are encountered when someone carries the medication with them. In fact, these dispensers are typically designed so that the blister pack compartments could be seen by the user. This allows the user to see where the remaining pills reside. For example, such a visual access is an important feature of dispensers for some types of birth control pills. Blister packs containing these birth control pills actually contain a series of different pills which must be taken in a specific sequence over the course of a month. Thus, the dispensers are designed so that the user can see the pills so that they can be taken in order on the intended days. These dispensers often include markings which indicate the day and order in which the pills are to be taken.

As it is important to the current dispensers employing blister packs to allow visual access to the pills, they typically have openings through which at least the compartments containing the pills are exposed. In addition, these dispensers typically have openings adjacent the frangible bottom wall of the blister pack pill compartments through which the pill is extracted. Thus, even though the pills are sealed within the blister pack compartment, the compartments are susceptible to puncture or damage which would jeopardize the pill contained within. For example, if such a dispenser were to be carried with the user in a pocket or handbag, items such as pens, keys, and the like could puncture the blister pack compartments or push the pill hard enough to tear the frangible bottom covering. This would expose the pills to moisture and humidity. The open structure of these dispensers also provides no protection against the degrading effects of heat; and also light assuming the pill compartment has a transparent top covering which is typically the case. It is also noted that the blister packs are usually loosely supported within the dispensers and the pills themselves are often able to move within the blister pack compartment. Thus, potentially degrading levels of shock and vibration caused by the movements of the person carrying the dispenser could be transmitted to the pills.

Accordingly, there is a need for a pill dispenser which overcomes the problems associated with current pill containers and dispensers. This improved pill dispenser would be small and lightweight such that it can be conveniently carried with a person at all times. The dispenser would also protect each pill contained within the dispenser from the detrimental effects associated with it being carried on the user's person, such as by moisture, high humidity, high temperature, light, shock and vibration. Further, the dispenser would be easy to use even when the user is in an impaired state and would dispense individual doses of medicine without the user having to touch them.

SUMMARY

The above-described objectives are realized with embodiments of the present invention directed to an improved pill dispenser.

A first preferred embodiment of the pill dispenser generally includes a pill carrier and dispenser housing. The preferred shape for this pill dispenser is such that its lateral cross section resembles an oval with a flattened side corresponding to the bottom of the pill dispenser. This is preferred as the flattened bottom prevents the pill dispenser from rolling when laid on that side.

The pill carrier of the dispenser has a plurality of throughholes constituting pill chambers. These pill chambers at least initially hold a pill that is sealed from the outside environment. Specifically, each pill is sandwiched between two sealing membranes (i.e. an upper membrane and a lower membrane) that hermetically seals the pill from the outside environment and suspends the pill from the wall of the pill chamber. The sealing membranes also conform to the shape of the pill so that the pill is unable to move between the membranes, and any space between the portions of the membranes surrounding a pill, not occupied by the pill itself, can be filled with an inert gas that will not chemically react with the pill. Thus, the pill is isolated from shock and vibration, as well as moisture and air by the pill carrier and its sealing membranes. While the pill carrier and pills can be made as a one-piece, disposable unit, it is also possible to make it in a refillable configuration. For example, the sealing membranes and pills can be configured to form a continuous pill pack comprising a plurality of pills which are individually sandwiched between the sealing membranes at prescribed separation distances. The prescribed separation distances correspond to the separation distances between pill chambers of the pill carrier. The pill carrier would have an upper portion and a lower portion, which are separable from one another to the extent necessary to allow the pill pack to be inserted between or removed from the upper and lower pill carrier portions. Thus, an expended pill pack can be removed and a fresh pack installed. In a preferred version of this refillable pill carrier, the upper and lower portions of the pill carrier are joined together along one side by at least one hinge. In this way the upper an lower portions of the carrier can be rotated open about the hinged side to insert a pill pack and thereafter rotated back into a closed position.

The dispenser housing includes a pill carrier slot into which the pill carrier is placed, and an opening forming a pathway from the slot to the exterior of the dispenser housing. In one preferred version of the housing, this opening takes the form of a cutout near the front of the housing. In addition, there is an integrated plunger disposed adjacent the slot and opposite the opening. This plunger preferably takes the form of a cantilevered arm connected to the body of the dispenser housing on only one side, namely the proximal end of the cantilevered arm. In one preferred version of the plunger, this is accomplished using an integrally formed living hinge. The just-mentioned punch head projects from the cantilevered arm toward the pill chambers. It is the punch head that pushes a pill contained within a pill chamber out of the housing when the plunger is actuated by the user. The length of the punch head is preferably limited to that which will cause the distal end of the punch head to contact the first membrane of the pill carrier and push the pill through the second sealing membrane without tearing loose any part of the first or second membrane. In this way, parts of the membrane are not dispensed with the pill.

Of course, the pill chamber has to be in alignment with the punch head and dispenser housing opening when the user actuates the plunger to dispense a pill. To this end, the pill carrier is displaceable within the pill carrier slot. In addition, there is an indexing mechanism capable of aligning each pill chamber of the pill carrier in sequence to the punch head and dispenser housing opening. In one preferred version of this indexing mechanism, a projection extends from the wall of the pill carrier slot. This projection is designed to extends into and retract from each of a series of indentations formed in the exterior surface of the pill carrier, thereby causing the pill carrier to be releasably held at one of plural index locations with respect to the dispenser housing. Each of these index locations corresponds to a position where one of the pill chambers of the pill carrier is in alignment with the punch head and dispenser housing opening. The projection retracts from a pill carrier indentation when a prescribed amount of longitudinally directed force is applied to the pill carrier by the user. In an alternate version of the indexing mechanism, a single indentation is used with a series of projections. Specifically, an indentation is formed in the wall of the pill carrier slot and a series of projections extend from the exterior surface of the pill carrier. Each projection is capable of extending into and retracting from the indentation to facilitate the indexing of the pill carrier within the dispenser housing as described above.

The first embodiment of the pill dispenser also preferably has a locking mechanism capable of releasably locking the pill carrier in a fully retracted position within the dispenser housing. This fully retracted position corresponding to a position wherein all the pill chambers are covered and protected by the dispenser housing. A preferred implementation of the locking mechanism is identical to the previously described indexing mechanism having the projection extending from the wall of the pill carrier slot and the indentations in the pill carrier, except that only one indentation is necessary in this case. When the pill carrier is placed in its full retracted position, the projection extends into the indentation, thereby causing the pill carrier to be held in place. As before, the projection retracts from the indentation when a prescribed amount of longitudinally directed force is applied to the pill carrier by the user. As is evident from the foregoing description, the locking and indexing mechanisms can be combined by simply adding an extra indentation to the pill carrier in the appropriate position to allow the pill carrier to be locked into its fully retracted position. An alternate version of the locking mechanism employing a single indentation in the pill carrier slot wall and a projection extending from an appropriate location on the pill carrier is also possible, and can be combined with the previously-described alternate version of the indexing mechanism.

A second preferred embodiment of the pill dispenser also generally has a pill carrier and dispenser housing similar to those described in connection with the first embodiment. However, the plunger associated with the dispenser housing of the first embodiment is eliminated. Instead, the pill carrier includes a plurality of integrated plungers, each of which forms a top covering of a respective one of the pill chambers. These plungers are use to individually dispense a pill from each pill chamber. The dispenser housing also lacks the aforementioned dispensing opening. It is not necessary because the pill carrier is simply drawn out of the dispenser's pill carrier slot until a pill chamber is exposed. The user then depresses the plunger associated with that chamber to dispense the pill. As before, the dispenser housing covers all the pill chambers when the pill carrier is fully retracted.

Each of the plungers has a projection extending into its associated pill chamber. This projection is used to push a pill out of the bottom of the pill chamber when the plunger is actuated by a user. Here again, the pill carrier employs first and second sealing membranes overlying and underlying the pill in each pill chamber respectively. Thus, it is preferred the projection have a length limited to that which will cause the distal end of the projection to contact the first membrane and push the pill through the second sealing membrane without tearing loose any part of the first or second membrane when the projection is fully extended into the pill chamber. Each plunger is joined at its periphery to the wall of the pill chamber. The material and thickness of the plunger in this peripheral region is made so as to cause the joint between the plunger and the wall of the pill chamber to be flexible, thereby allowing a user to actuate a plunger by depressing it from the top. The plunger is held in a retracted position while a pill is residing in the pill chamber, but once depressed by a user in order to dispense the pill, the plunger remains in the depressed position to provide an indication to the user that the pill chamber is empty.

One other difference between the first and second embodiments is that while the previously described locking mechanism is still very advantageous in preventing an inadvertent opening of the pill dispenser that could jeopardize the pi lls, the indexing mechanism is not absolutely needed. Thus, in a it is preferred that the locking mechanism be included. However, the indexing mechanism can be eliminated if desired.

The above-described pill dispenser embodiments have many advantages. They allow a patient to conveniently carry medication with them a t all times, and have ready access to it. In addition, the dispenser can use sealed pill packs having individually sealed pills. In doing so, the medication is protected from the outside environment which could degrade it.

As the pill dispenser is to b e carried by a patient at all times, it is preferably small and lightweight. For example, the pill dispenser could be small enough to be carried on a necklace or keychain. The size is mostly dictated by the size and number of pills to be carried. The dispenser is designed to dispense one pill at a time or multiple pills from a single pill chamber, while keeping the remaining supply of pills secure and protected within the body of the pill dispenser. In this way, the pills cannot be inadvertently spilled as is the case with currently existing pill dispensers on the market. In addition, the medication is protected from the outside environme nt by the pill pack and dispenser. Thus, environmental factor such as moisture, high temperatures, light, and vibration will not effect the pills. Additionally, the materials making up the pill pack are chosen such that they do not react with the medicine. The pill carrier, plungers, and dispenser housing can be made from Teflon aluminum, Teflon coated aluminum, aluminum coated Teflon, or combinations of these material. A transparent plastic might even be employ ed so that the number of pill remaining can be readily ascertained by the user. The dispenser can also be colorized or color coded to designate the type of medication contained therein. For example, the housing could be colored or color coded. Alternately, the housing could be made of a transparent plastic and the pill carrier could be colored or color coded. Further, the color or color coding employed could be made to match that used by the pill manufacturer on the pills themselves.

Most importantly, the dispenser is easily operated by the patient who may be older or incapacitated (such as by a heart patient having an attack of angina which requires the immediate ingestion of a nitroglycerin pill). It is also noted that the pill can be easily dispensed directly into the mouth of the patient without having to be handled. This precludes the possible contamination of the pill, for example by a patient having wet, dirty, or sweaty hands at the time the medication is to be taken. This has further advantage in that even if the pill has been fractured or powderized to some extent due to excessive vibration and shock, the entire dose is still ingested.

In addition to the just described benefits, other objectives and advantages of the present invention will become apparent from the detailed description which follows hereinafter when taken in conjunction with the drawing figures which accompany it.

DESCRIPTION OF THE DRAWINGS

The specific features, aspects, and advantages of the present invention will become better understood with regard to the following description, appended claims, and accompanying drawings where:

DETAILED DESCRIPTION OF THE PREFERRED EMBODIMENTS

Figure 1B:
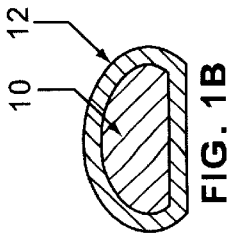
FIG. 1B is a cross-sectional end view of the pill dispenser of FIG. 1A

In the following description of the preferred embodiments of the present invention, reference is made to the accompanying drawings which form a part hereof, and in which is shown by way of illustration specific embodiments in which the invention may be practiced. It is understood that other embodiments may be utilized and structural changes may be made without departing from the scope of the present invention.

Referring to FIGS. 1A–D, in general, the pill dispenser according to a first embodiment of the present invention has two main components, a pill carrier 10 and a dispenser housing 12. The dispenser housing 12 acts, in part, as a protective sleeve surrounding the pill carrier 10 and the pill contained therein. Preferably, the housing 12 is open at its forward end and closed at its aft end. The pill carrier 10 is sized to fit into the open end of the dispenser housing 12 and to slide longitudinally within the housing 12. A closed aft end of the dispenser housing 12 is preferred to make it less likely that the pill carrier 10 could be inadvertently moved within the housing should a force be applied to the aft end of the pill dispenser, such as might occur when the pill dispenser is being carried by the user. Of course, if motion of the pill carrier is prevented in other ways, or such motion is not of concern, the aft end of the dispenser housing could be open instead (not shown). Both the dispenser housing 12 and the pill carrier 10 have a lateral cross-sectional shape approximating an oval with a flattened side corresponding to the bottom of the pill dispenser, as best shown in FIG. 1 B. While the just described shape is preferred, other lateral cross-sectional profiles can alternately be employed (e.g. circular, square, rectangular, triangular, etc.), as desired. In addition, the lateral cross-sectional shape of the pill carrier need not be the same as that of the exterior of the dispenser housing. However, in the foregoing configuration, the lateral cross-section of the interior chamber of the dispenser housing 12, hereinafter referred to as the pill carrier slot, would preferably match the shape of the pill carrier 10. Preferably, the pill carrier slot in the housing 12 is sized so that a sliding fit is formed with the pill carrier 10 once it is installed. This ensures the pill carrier 10 can be moved in relation to the housing 12, but that there little or no play between the two components in the lateral or vertical directions.

The housing 12 has an integral plunger 14 with a punch head 18. The plunger 14 is preferably a cantilevered structure having an elastic hinge 16 at its proximal end. The hinge 16 provides the only connection between the plunger 14 and the rest of the dispenser housing 12. When the pill carrier 10 is in its full retracted position (i.e., when the pill carrier is fully inserted into the dispenser housing 12), the plunger 14 resides in well 19 formed in the body of the pill carrier towards its forward end. This gives a streamlined shape to the pill dispenser when the pill carrier 10 is retracted, thereby making less likely that the plunger will catch on something as the user is attempting to remove the dispenser from a pocket, purse, etc. In order to ensure the plunger 14 remains in the well 19 when the pill carrier 10 is retracted, it is preferred that the hinge 16 be constructed so as to bias the plunger downward into the well. However, it is also preferred that the downward force associated with this bias not be so strong as to make it difficult for the plunger 14 to be retracted out of the well when a pill 22 is to be dispensed, or to push so hard on the top of a pill that the pill is partially of fully ejected (as will be discussed in detail later). Further, it is preferred that the shape of the rearward facing side of the plunger 14 be made such that the plunger slides up and out of the well 19 when the user pushes the pill carrier 10 out of the dispenser housing 12 (as also will be described in more detail later). While the aforementioned downward bias is preferred, other methods of retaining the plunger 14 in the well 19 could also be employed, such as an appropriate mechanical latch that would catch the plunger when a user pushes it into the well and automatically release the plunger when a user pushes the pill carrier 10 out of the housing 12.

In one preferred embodiment. the dispenser housing 12 and plunger 14 are formed together from a plastic with suitable elastic properties such that the connection between the housing and the plunger forming the elastic hinge 16 constitutes a so-called living hinge. This living hinge is not a separate element, but rather is a region of the plastic material at the transition between the dispenser housing 12 and the plunger 14 that is reduced in thickness to a sufficient degree to provide a hinging action between the aforementioned components. While the living hinge is preferred, the elastic hinge 16 could be formed in other ways. For example, the plunger 14 could be formed separately and then integrated with the dispenser housing 12. The integration could be accomplished in a variety of ways. For example, the plunger 14 could be integrated with the housing 12 using an adhesive. Alternately, the plunger 14 could be fused to the housing 12, or a mechanical hinge might be employed. In sum, any appropriate method can be used to create the elastic hinge 16, as long as the result is the plunger 14 having the aforementioned bias (if employed) and sufficient flexibility to allow a user to depress it to dispense a pill.

Figure 2A:
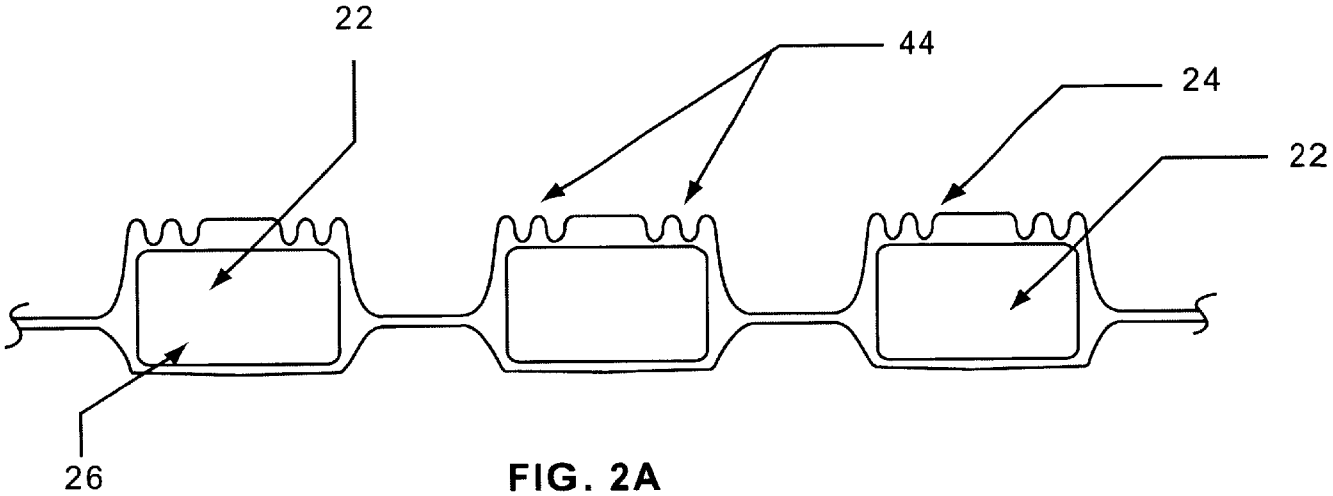
FIG. 2A is a cross-sectional view of a part of a pill pack constructed in accordance with the present invention.
Figure 2B:
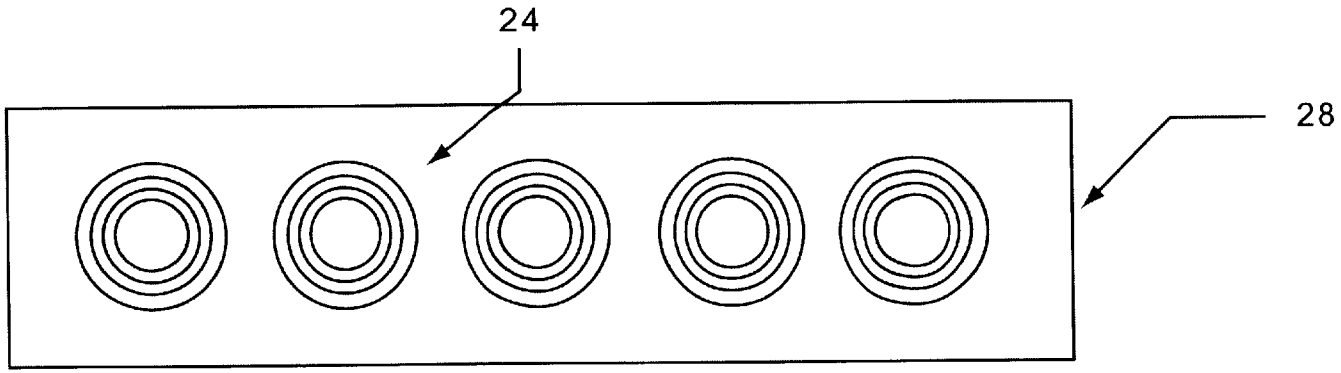
FIG. 2B is a top view of the complete pill pack of FIG. 2A.
Figure 3:
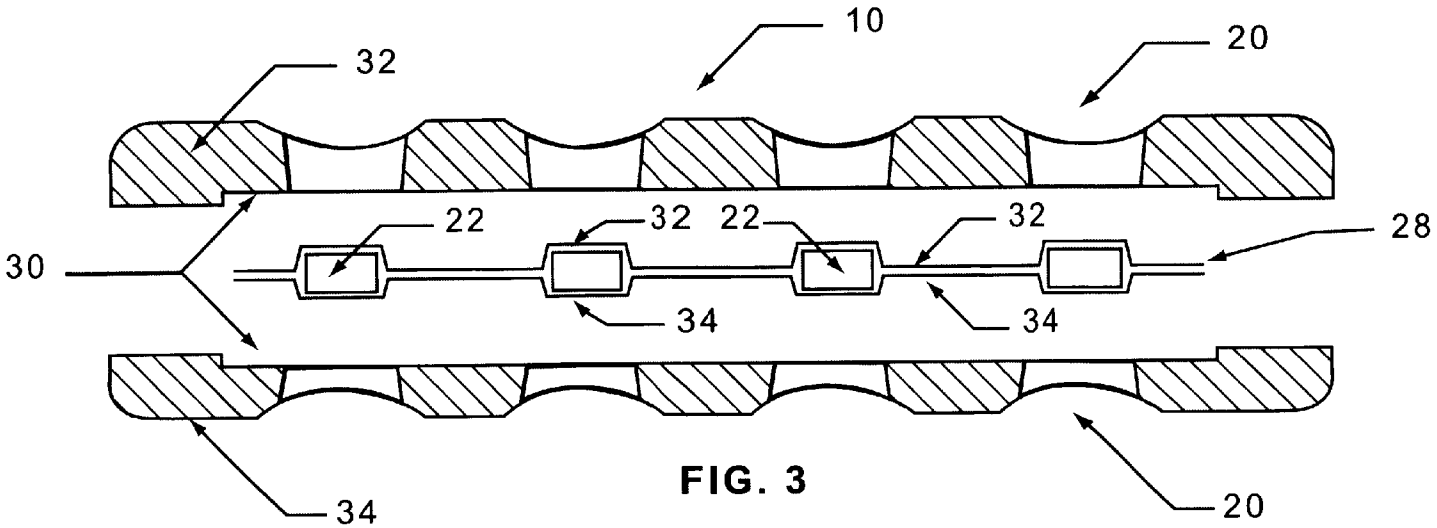
FIG. 3 is an exploded, cross-sectional side view of a refillable pill carrier constructed in accordance with the present invention.

The pill carrier 10 preferably employs a pill pack 28, as depicted in FIGS. 2A and 2B. In the depicted embodiment, the pills 22 are sandwiched between two membrane strips 24, 26 and spaced apart along the length of the pill pack 28. The pills 22 are held securely in a space formed by the membranes 24, 26 surrounding the pill. Preferably, the membranes 24, 26 generally conform to the shape of the pill 22 so that the pill is unable to move within the space formed between the membranes. In addition, the pill 22 is hermetically sealed by the membranes 24, 26. Any unoccupied areas within the space between the membranes 24, 26 can be filled with a inert gas that will not chemically react with the pill 22, thereby extending the shelf life of the medication. FIG. 3 is an exploded view showing the pill pack 28 incorporated into a pill magazine 30 of a refillable version of the pill carrier 10 having an upper portion 32 and a lower portion 34. The aforementioned pill pack 28 is sandwiched between upper and lower sections 32, 34 of the pill carrier, with the encased pills 22 being centered within the pill chambers 20. The pill chambers 20 have a minimum cross-sectional area that is larger than that of the encased pills 22 so as to suspend the pills by the encasing membranes 24, 26 from the side wall of the pill chambers 20. This suspension of the pills 22 acts to dampen the transference of shock and vibration from the dispenser to the pills. In an alternate version of the pill carrier, the two portions of the pill carrier are either permanently affixed to each other or even integrally formed as a single unit around the pill pack. This would result in a disposable pill carrier which would be replaced once all or some of the pills are expended. Of course, neither of these two version the pill pack must have the rectangular shape shown in FIG. 2B, or even be assembled prior to the construction of the pill carrier. However, at a minimum, some portion of the upper and lower membranes must extend out from each pill so as to be trapped between the upper and lower halves of the pill carrier and provide the aforementioned shock and vibration mitigating suspension of the pill within the pill chamber.

Figure 4:
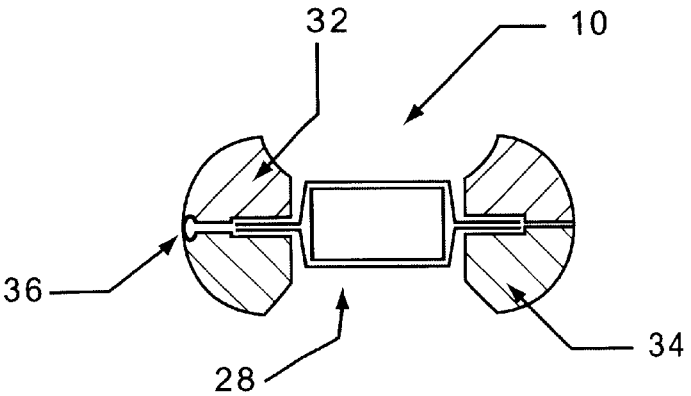
FIG. 4 is a cross-sectional end view of a hinged, refillable pill carrier constructed in accordance with the present invention.

The two portions 32, 34 of the pill carrier in the refillable version could include interfacing structures (not shown) which would releasably lock the sections together. Thus, when some or all of the pills 22 have been expended, the portions 32, 34 could be separated, a new pill pack 28 inserted, and then locked back together. The interfacing structures employed can be any conventional type appropriate for the task. Further, the upper and lower portions 32, 34 of the pill carrier need not be separate pieces. In one preferred embodiment, the two portions 32, 34 are joined by a longitudinal hinge structure 36 on one side, as shown in FIG. 4. This hinge structure 36 can be one continuous hinge running the entire length of the side of the pill carrier, as shown, or it can be somewhat shorter extending along just a portion of the side. Alternatively, multiple hinges spaced periodically along the side of the pill carrier could be employed. In one preferred embodiment, the pill carrier is formed of a plastic material with suitable elastic properties such that the hinge structure joining the upper and lower portions of the pill carrier can be realized in the form of a living hinge. As explained previously, a living hinge is not a separate element, but rather is a region of the plastic material at the transition between the two portions of the carrier that is reduced in thickness to a sufficient degree to provide a hinging action between the aforementioned components. While the living hinge is preferred, the hinge or hinges could also be formed in other ways. For example, the two portions of the carrier could be formed separately and then joined in any number of ways, such as by the use of an adhesive. Alternately, they could be fused together, or a mechanical hinge might be employed. In operation, the above-described pill pack 28 would be inserted between the upper and lower portions 32, 34 of the pill carrier while the carrier 10 is in an open position. The pill carrier 10 would then be closed to trap the pill pack 28 between the upper and lower carrier portions 32, 34. Appropriate interfacing structures (not shown) are employed on the side opposite the hinge structure 36 to releasably lock the two portions together.

It is also noted that while, FIGS. 1 through 4 depict a pill carrier 10 designed for disk-shaped pills 22 oriented in a flat position, the pill chambers can be sized and shaped to accommodate other shapes and orientation of the medication. For example, the chambers would have an oblong cross-sectional shape to accommodate a capsule in a flat orientation, or a circular cross-section to accommodate a capsule place on end within the pill carrier. Similarly, the chamber might have a rectangular slot-shaped cross-section if a disc shaped pill where placed on end in the carrier. Further, while the depicted embodiments show only one pill per pill chamber, this need not be the case. Multiple pills could be stacked or positioned side by side in the same pill chamber. This multiple pill configuration can be quite useful where a dose of medication constitutes more than one pill. The concept can be extended to encapsulating pills containing different medication in the same pill chamber for use in those cases where multiple medications must be taken at the same time. Finally, the individual pill chambers might contain different medications or dosages in cases where this would be advantageous.

The lower membrane of the pill carrier is also preferably weakened, such as by scoring in a certain pattern, where it underlies a pill. This facilitates pushing the pill through the lower membrane to extract it from the chamber as the weakened areas are designed to rupture when relatively little force is applied. Specifically, the weakened areas are designed to rupture under a force which is less than that which would fracture or crush the pill being pushed against the lower membrane. These weaken areas also dictate the pattern of the rupture. It is preferred that this pattern be such that an opening large enough to pass the pill therethrough is created, but that the torn sections of the membrane remain attached. In this way, pieces of the lower membrane are not ejected from the dispenser with the pill, and so cannot be inadvertently ingested when a pill is dispensed directly into the mouth of the user.

Referring once again to FIG. 2A, the upper membrane 24 of the pill carrier is preferably flexible in those areas overlying a pill 22 so that it can be collapsed under pressure from the plunger. To this end, it can optionally include folds 44 that provide an inwardly telescoping capability to the upper membrane 24 in the areas overlying the pills 22.

Figure 1A:
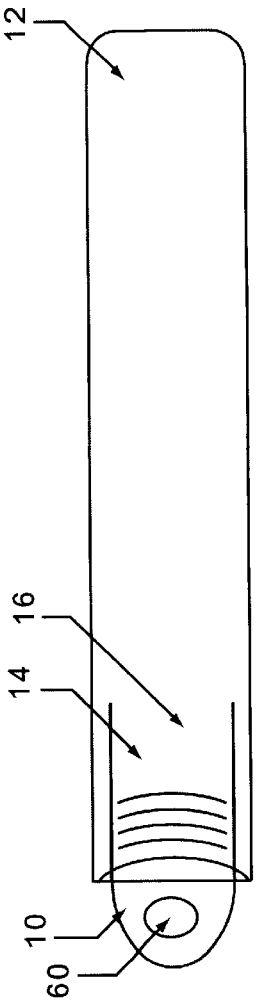
FIG. 1A is a top view of an embodiment of a pill dispenser constructed in accordance with the present invention.
Figure 1C:
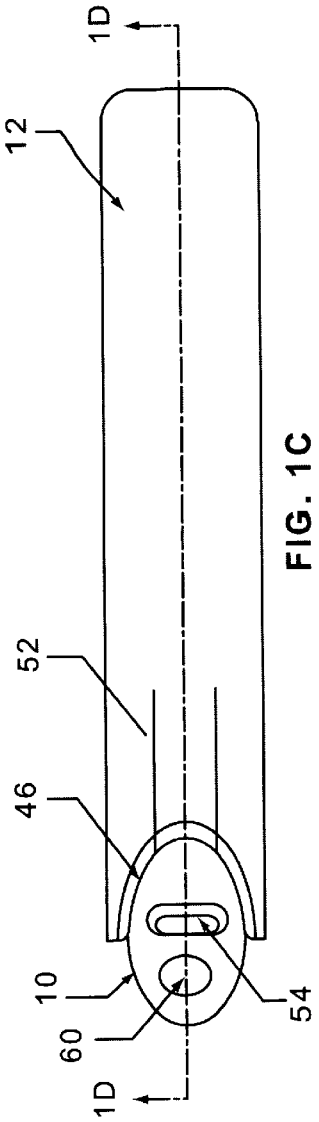
FIG. 1C is a bottom view of the pill dispenser of FIG. 1A.

Referring again to FIGS. 1A–D, in operation, pill chambers 20 are lined up with the dispenser opening 46 of the housing (as will be explained in detail later in this description). The dispenser opening 46 preferably takes the form of a cutout in the bottom of the dispenser housing 12 on the end thereof having the plunger 14, as best shown in FIG. 1C. Thus, the dispenser opening 46 is directly opposite from the plunger 14. While a cutout is preferred, the dispensing opening could alternatively take the form of the channel or hole through the bottom wall of the dispenser housing. Once a pill chamber 20 is lined up with the opening 46, all the user need do is press down on the plunger 14. The punch head 18 of the plunger pushes against the upper membrane 24 and the underlying pill 22, thereby causing the pill to rupture the weakened area in the lower membrane 26. The pill 22 is then pushed through the ruptured lower membrane 26 by the punch head 18 and falls out the dispenser opening 46.

Figure 1D:
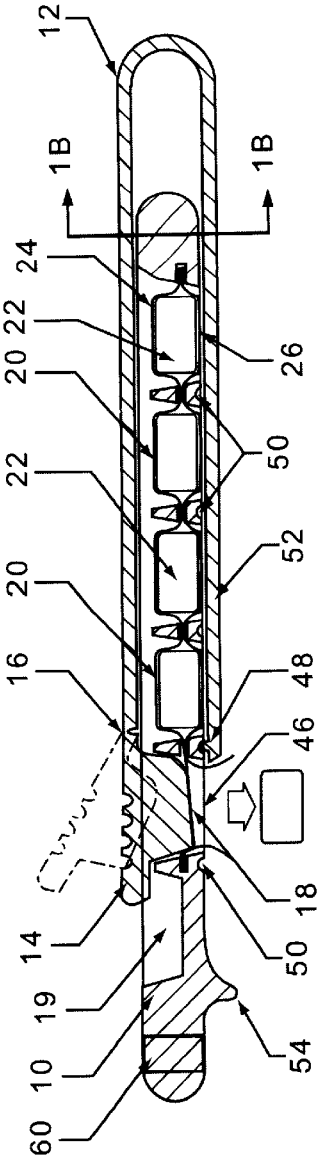
FIG. 1D is a cross-sectional side view of the pill dispenser of FIG. 1A.

The length of the punch head 18 is made just long enough to ensure the pill 22 is completely pushed free of the lower membrane 26. As the pill 22 itself is used to rupture the lower membrane 26, the punch head 18 does not have to extend completely through the membrane in order to accomplish the task of ejecting the pill. However, at the same time, it is preferred that the punch head 18 extend far enough into the pill chamber 20 to ensure that the contents thereof, whether it be a pill, capsule, powderized medication, or the like, is completely ejected while still ensuring the punch head will not tear the ruptured pieces of the lower membrane 26. It is believed limiting the travel of the punch head 18 to just above the lower membrane 26 will achieve all the aforementioned competing goals. FIG. 1D best illustrates the action of the plunger 14 and its punch head 18 in dispensing a pill 22. Note that in the depicted embodiment the downward motion of the plunger 14 is stopped by the body of the pill carrier 10 so as to allow the punch head 18 to extend no further than about the upper surface of the lower membrane 26. In this way, the pill 22 is positively forced through the lower membrane 26 and out of the pill dispenser, while the leaves of the now perforated lower membrane remain attached and are not released with the pill.

The face of the punch head 18 can be flat, or curved. The curved version of the punch head 18 would be useful in dispensing capsules which are oriented on edge in the pill carrier 10—especially soft capsules such as so-called gelcaps. In addition, the face of the punch head 18 could have an angled face. An angled face initially contacts only a small area of the upper membrane 24 overlying the edge of the pill chamber 20, and then progressively contacts more and more of the membrane as the punch head moves down through the pill chamber. In this way the angled face facilitates a smooth penetration of the upper membrane 24 by the punch head 18 and places less pressure on the pill itself. This is particularly advantageous when the pill dispenser is used for soft pills such as nitroglycerin.

It is also noted that a projection of the lateral cross-sectional shape of the punch head 18 is made to correspond to the cross-sectional shape of the pill chamber 20 (e.g. round, oblong, rectangular, etc.). In addition, the maximum size of the projected cross-sectional shape of the punch head 18 is preferably just slightly smaller than the minimum cross-sectional shape of the pill chamber 20 to prevent any jamming.

The pill dispenser also preferably includes a mechanism for locking the pill carrier 10 into a fully retracted position inside the dispenser housing. This fully retracted position corresponds to a position where all of the pill chambers 20 in the pill carrier are surrounded by the body of the dispenser housing 12. The locking mechanism prevents the pill carrier 10 from inadvertently sliding into a position where one or more of the pill chambers 20 are exposed. For example, this could occur if the pill dispenser is jostled about when carried in a user's pocket or in a purse. Should the pill chambers 20 be exposed in this manner, there is a risk that a pill 22 could be accidentally ejected (either entirely or partially), or that the lower membrane 26 could be punctured. In all these cases, the pill 22 would be exposed to the outside environment, thereby potentially rendering it useless. For example, exposure of a nitroglycerine pill in this manner would degrade the medication, probably to the point where it would not be effective in relieving an angina attack.

In addition, the pill dispenser also preferably includes a mechanism for indexing the pill carrier 10 in relation to the dispenser housing 12. This mechanism is used to provide a positive stop between the pill carrier 10 and the dispenser housing 12 that is readily perceivable by the user. The indexing mechanism provides one of the aforementioned stops each time a pill chamber 20 lines up with the dispenser housing opening 46 and the plunger's punch head 18. Thus, the indexing mechanism provides a stop at each location where a pill 22 can be dispensed. In one preferred embodiment the locking mechanism and the indexing mechanism are combined. Essentially, this combined mechanism includes a retractable projection 48 extending inward from the bottom wall of the interior cavity of the dispenser housing 12. The retractable projection 48 is biased so as to exert an inward force against the bottom surface of the pill carrier 10. Preferably, the projection 48 has a rectangular shape and extends laterally across the bottom wall of the dispenser housing's interior cavity. In addition, it is preferred that the distal end of the projection 48 be rounded so as to facilitate its movement against the surface of the pill carrier 10. The projection 48 rides along the bottom surface of the pill carrier 10 as the carrier is moved in relation to the dispenser housing 12, until it encounters one of a series of indentations 50, 50' formed in the pill carrier's bottom surface. These indentations 50, 50' extend laterally across the bottom of the pill carrier 10 and are spaced periodically along its length. The length of each indentation 50, 50' in the lateral direction is made such that it extend past both ends of the projection 48 when these two structures are in alignment with each other. The width and/or depth of each indentation 50, 50' is made so that the bias associated with the projection 48 forces the distal end of the projection into the indentation. The depth to which the projection 48 extends into a particular indentation 50 determines the amount of longitudinally directed force required to dislodge the projection from an indentation. The forwardmost indentation 50' of the pill carrier is located such that all of the pill chambers 20 are covered by the body of the dispenser housing 12 when the projection 48 is aligned with this indentation. The forwardmost indentation 50' and the projection 48 when aligned therewith constitute the aforementioned locking mechanism that locks the pill carrier 10 into its fully retracted position. The forwardmost indentation 50' is sized so that the projection 48 extends into it to a depth sufficient to ensure the pill carrier 10 cannot be inadvertently moved in relation to the dispensing housing 12 when subjected to forces reasonable expected to occur while the user is carrying the pill dispenser. However, it is not made so deep as to cause it to be overly difficult to dislodge the projection 48 from the forwardmost indentation 50' when the user wants to "open" the dispenser and move the pill carrier 10 to a pill dispensing position. Similar indentations 50 are located at positions on the bottom of the pill carrier 10 where the projection 48 will be forced into them when a pill chamber 20 is in alignment with the punch head 18 of the plunger and dispensing opening 46. As these indexing stops are temporary in nature, the force required to dislodge the projection 48 need not be as strong as the forwardmost, "locking" indentation 50'. As such the "indexing" indentations 50 can be sized so that the projection 48 extends into the indentations to a lesser depth than associated with the "locking" indentation 50'. This is preferably done by making the indentations 50 either shallower, or narrower. Generally, the indexing indentation 50 need only create a readily discernable stop when the projection 48 is forced into it, and nothing more.

The retractability and bias characteristics of the projection 48 can be accomplished in a variety of ways. One preferred structure for this purpose is best shown in FIG. 1C. In this embodiment, the projection 48 is formed at the end of a cantilevered section or arm 52. This cantilevered section 52 is similar to that described in connection with the preferred embodiments of the plunger 18 and can be constructed in the same ways. It is noted that while the depicted projection structure is shown with its distal end forming a portion of the edge of the dispensing opening 46, this need not be the case. The distal end of the projection structure could, for example, terminate within the body of the housing 12 itself somewhat back from the edge of the opening 46. In an alternate preferred embodiment, the projection takes the form of a structure made from a flexible, resilient material that extends from the interior wall of the dispenser housing. In this case, the projection itself compresses to provided the aforementioned retractability characteristic thus allowing the pill carrier to be moved in relation to the housing. The compressed projection then springs back into shape when in alignment with one of the indentations, thereby extending into that indentation as described previously. It would also be possible to make at least the portion of the dispensing housing adjacent the projection of a flexible material so that it will give enough to allow the projection to retract and the pill carrier to be moved within the housing, but resilient so that it springs back and forces the projection into an aligned indentation. This latter embodiment can be expanded on somewhat to provide another advantageous feature. Specifically, the indentations described previously could be lengthened so as to extend all the way around the exterior of the pill carrier. The projection in this embodiment would take the form of an O-ring that is embedded into the interior wall of the housing, such that only a portion of its width extends into the cavity. The O-ring would, of course, conform to the shape of the cavity walls and be made of a material that provides the desired flexibility and resilience. This embodiment provides the added benefit of sealing the interior of the pill dispenser via the interface between the O-ring and the pill carrier. For example, this arrangement would provided a moisture and dirt barrier preventing these elements from getting into the interior of the dispenser housing. Granted, as described earlier, the pills are already sealed from the outside environment within the pill carrier. However, the O-ring would provide an added measure of protection. It is also noted that when a configuration whereby the dispenser housing is open at its aft end is employed, a second O-ring can be installed in a similar manner at a location that would interface with the aft end of the pill carrier when it is fully retracted into the housing. The aft O-ring would thus prevent contaminants from infiltrating into the pill carrier cavity from the open aft end of the housing.

In all the foregoing described embodiments of the projection and indentations forming the locking and indexing mechanisms, the projection was incorporated into the dispenser housing, and the indentations were formed in the pill carrier. However, the reverse is also possible. Essentially, there would be a single indentation formed in the interior surface of the housing at the location previously associated with the projection. For example, the indentation might reside at the end of the aforementioned cantilevered structure used to impart the necessary retractability to the combined locking and indexing mechanism. Similarly, each of the previous indentations in the pill carrier would be replaced with a projection. The structures and attributes described above would remain the same and the pill dispenser would operate in the same manner.

In order to facilitate the opening, closing, and indexing of the pill dispenser, certain external features are preferably incorporated. As shown in FIGS. 1A–D, a finger stop 54 is formed on the bottom of the pill carrier 10 near its forward end. This finger stop 54 can be employed in the following manner. A user places his or her thumb against the aftward directed face of the finger stop 54 at the front of the pill carrier, while holding the dispenser housing in the same hand. Then, the user pushes forward with his or her thumb to release the pill carrier 10 from its locked position, and to extend it progressively from one indexing stop to the next. A user can simply push down on the forward end of the pill carrier 10 with his or her thumb while holding the outside of the dispenser housing 12 with the same hand, in order to retract the pill carrier 10 and lock it back into its fully retracted position. Note that the above-described movements can be accomplished with only one hand, and without having to look at the pill dispenser—a significant advantage.

While the foregoing structures employing indentations and projections are preferred, it is not intended to limit the locking and indexing mechanisms to just the described embodiments. Rather, any appropriate mechanism, combined or otherwise, can be employed to achieve the desired locking and indexing features. For example, in some applications it may be desired to have a more complex locking mechanism so that the pill dispenser is made "child-proof".

Various indentations and ridges can optionally be added to portions of the exterior of the pill carrier and dispensing housing to facilitate gripping the pill dispenser and manipulating it with ones fingers. In addition, these ridges and indentations provide the user with tactile indicia that can be employed to determine the orientation of the pill dispenser (e.g., top-bottom, front-back, etc). Such indicia can be useful when the pill dispenser is being operated in the dark or while driving, or in any situation where the user cannot look directly at the dispenser. In addition, as shown in FIGS. 1A, 1C and 1D, a small through hole 60 can be provided near the forward end of the pill carrier 10. This hole 60 can be employed to attach the pill dispenser to a key ring or necklace to make it easier for the user to carry the dispenser on their person.

Figure 5A:
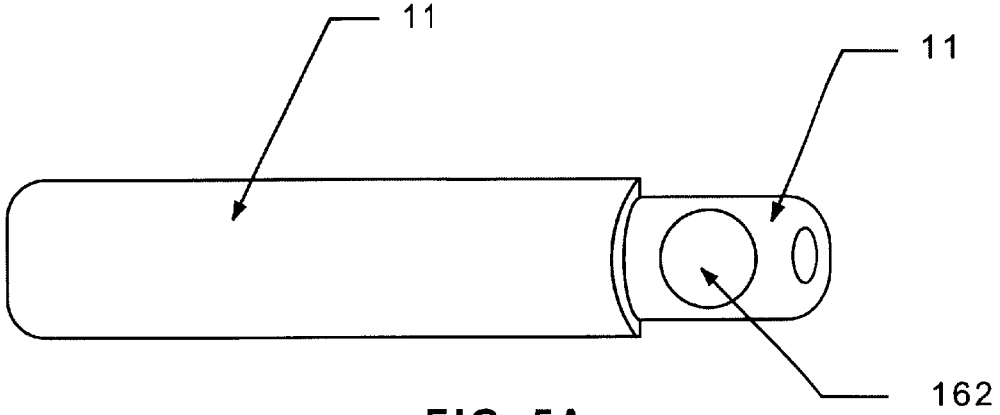
FIG. 5A is a top view of a second embodiment of a pill dispenser constructed in accordance with the present invention.
Figure 5B:
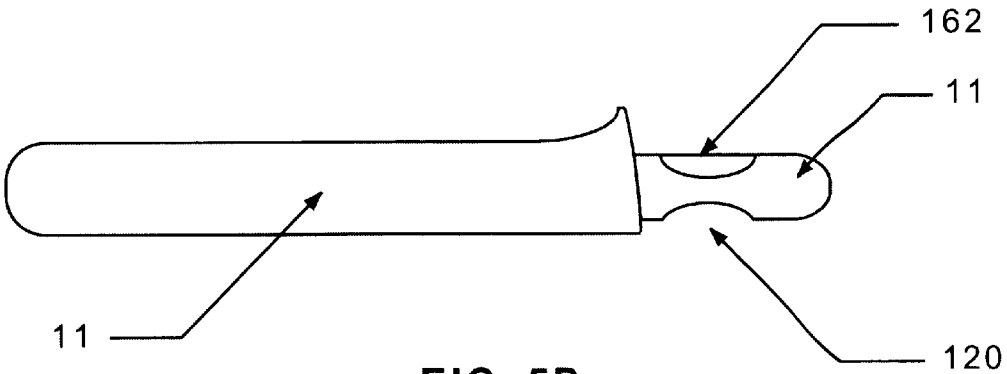
FIG. 5B is a side view of the pill dispenser of FIG. 5A.

FIGS. 5A–B depict another version of a pill dispenser constructed in accordance with the present invention. This embodiment is the same in many respects to the previously-described embodiment with the major exception that the plunger (14 of FIGS. 1A–D) associated with the dispenser housing 112 has been eliminated. In its stead, the pill carrier 110 has been modified to incorporate separate plungers 162 in each of the pill chambers 120. In addition, while it is still particularly advantageous to include a locking mechanism, the inclusion of a mechanism for indexing the pill carrier is not as important. A locking mechanism, such as the ones described previously, is useful in preventing the pill carrier 110 from inadvertently sliding into a position where one or more of the pill chambers 120 are exposed. However, an indexing mechanism, while perhaps providing a degree of tactile feedback to the user that a pill chamber has been exposed, is not critical in the present embodiment. Essentially, there is no need to align the pill chambers with a plunger or dispensing opening, and so no requirement to ensure the pill carrier stops at prescribed positions as was the case with the previously-described embodiment. Therefore, it is preferred that a locking mechanism be employed in the present embodiment to provide a positive means of holding the pill carrier in its fully retracted position. However, the indexing mechanism can be eliminated if desired.

Figure 6A:
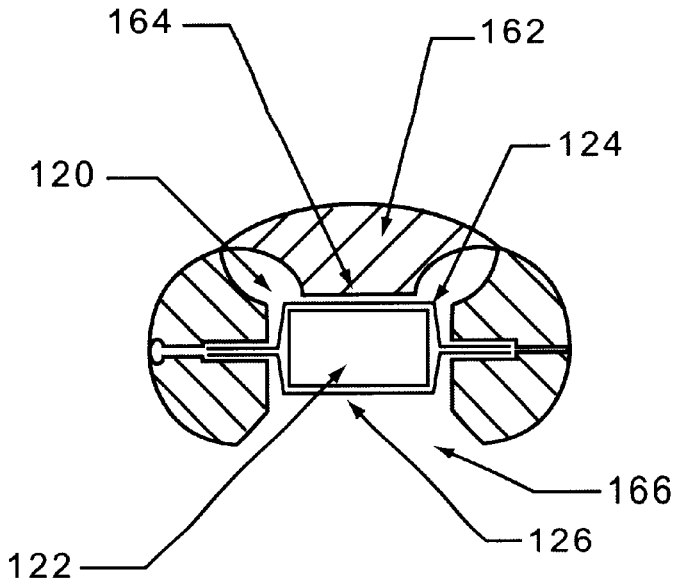
FIG. 6A is a cross-sectional end view of a pill carrier for use with the dispenser of FIGS. 5A and 5B showing the plunger mechanism of the pill carrier prior to being depressed.

Referring to FIG. 6A, each of the aforementioned plungers 162 respectively encloses the top of one of the pill chambers 120. On the interior side of the plunger 162 is the projection 164 extending toward the pill 122. Although this projection 164 could have many different shapes, it is preferred that it have a lateral cross-sectional shape essentially matching the shape of the surface of the pill 122 facing the plunger projection. For example, if the pill has a disk shape with one of the flat sides facing the plunger projection 164 as shown in FIG. 6A, then the projection would preferably have a circular lateral cross section and a flat surface. However, if the pill is a capsule with an oblong shape and oriented on its side in the pill chamber, then the plunger projection would preferably have an oblong lateral cross-section. In addition, the interior facing surface of the plunger projection would preferably be cupped so as to conform with the curved surface of the pill.

The plunger projection 164 can extend up to and contact the surface of the upper 124 membrane that covers the top surface of the pill 122 in its fully retracted position. Alternatively, the plunger projection 164 can have a shorter extension length so as to be offset from the pill 122, as shown in FIG. 6A. The shorter extension length is preferred because it reduces the risk that of a slight, inadvertent depression of a plunger 162 will result in a ruptured lower membrane 126 or even a partially ejected pill 122. However, the length of the projection 164 is still made long enough to ensure the pill 122 is completely pushed free of the lower membrane 126 when the plunger 162 is fully depressed. As with the first-described embodiment, it is preferred that the projection 164 extend far enough into the pill chamber 120 to ensure that the contents thereof, whether it be a pill, capsule, powderized medication, or the like, is completely ejected while at the same time ensuring the projection does not tear the ruptured pieces of the lower membrane 126. It is believed limiting the travel of the projection 164 to just above the lower membrane 126 will achieve these goals.

The plunger 162 is affixed at its periphery to the upper edge of the pill chamber 120. While this can be accomplished via any appropriate method (e.g. via an adhesive, by fusing, etc.), it is preferred that the plunger 162 be integrally formed as part of the pill carrier itself. The thickness of the peripheral region of the plunger 162 where it connects to the edge of the pill chamber 120 is thinner than the central portion of the plunger. In addition, at least the peripheral region of the plunger 162 is flexible enough so as to allow the plunger to be depressed into the pill chamber 120. FIG. 6A shows the plunger 162 as it appears prior to being depressed by the user, whereas FIG. 6B shows the plunger 162 after it has been depressed.

Figure 6B:
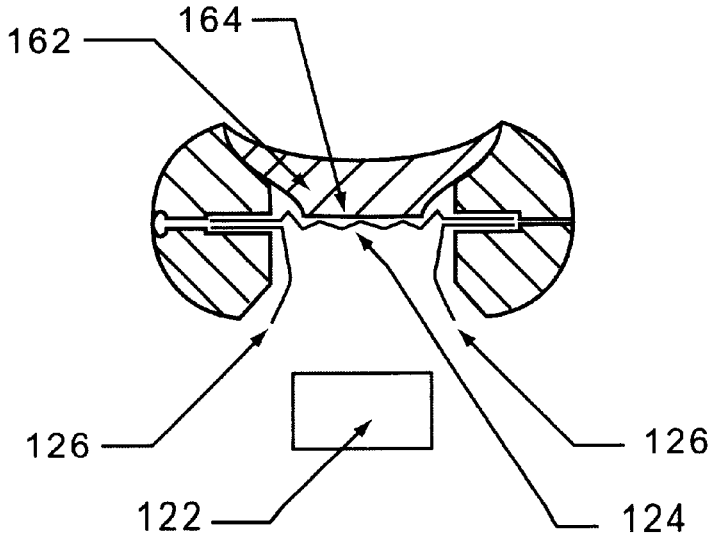
FIG. 6B is a cross-sectional end view of a pill carrier for use with the dispenser of FIGS. 5A and 5B showing the plunger mechanism of the pill carrier after being depressed.

As can be seen from FIGS. 6A and 6B, the plunger 162 pushes the pill through the lower membrane 126 and out of the bottom of the pill chamber 120 via a pill dispensing opening 166 in the pill carrier. In the embodiment depicted in FIGS. 6A and 6B, the walls of the opening 166 have a concave shape. However, any shape is acceptable as long as it allows the pill 122 to pass through unimpeded.

Once the plunger 162 has been depressed and the pill 122 dispensed it is preferred that the plunger not return to its original, un-depressed position. In this way, the user can distinguish between a pill chamber 120 containing a pill 122 and an empty one. Ensuring that the plunger 162 does not return to its un-depressed position can be done in a variety of ways. For example, an appropriate mechanical assembly (not shown) could be incorporated so that the plunger becomes latched into position when depressed. Alternately, the material used to form the peripheral portion of the plunger could be made such it permanently deforms during the depressing motion, thereby precluding the plunger from springing back to its original position. It is noted that the upper portion of the pill chamber 120 is sized and shaped to accommodate a portion of the pill 122 prior to it being dispensed, and the plunger 162 after the pill is gone.

While the invention has been described in detail by reference to the preferred embodiment described above, it is understood that variations and modifications thereof may be made without departing from the true spirit and scope of the invention.

Wherefore, what is claimed is:

1. A pill dispenser comprising:

a pill carrier having a plurality of through-holes comprising pill chambers, each pill chamber at least initially holding a pill which is sealed from the outside environment and contained within the pill chamber; and a dispenser housing comprising, a pill carrier slot into which said pill carrier is disposed and an opening forming a pathway from the slot to the exterior of the dispenser housing, and an integrated plunger apparatus disposed adjacent said slot and opposite said opening, said plunger apparatus comprising a projecting punch head capable of extending into a pill chamber so as to push a pill contained within the pill chamber to the exterior of the housing through the dispenser housing opening whenever the plunger apparatus is actuated by a user and the pill chamber is in alignment with the punch head and dispenser housing opening, and wherein the pill carrier is displaceable within said pill carrier slot to allow the sequentially alignment of each of said pill chambers with said punch head and dispenser housing opening.

2. The pill dispenser of claim 1, wherein a lateral cross-section of the dispenser housing has peripheral shape approximating an oval with a flattened side corresponding to the bottom of the pill dispenser, said flattened bottom of the pill dispenser preventing it from rolling when laid on that side.

3. The pill dispenser of claim 1, wherein a pill held within a pill chamber of the pill carrier is sandwiched between two sealing membranes capable of sealing the pill from the outside environment and suspending the pill by these membranes from the wall of the pill chamber.

4. The pill dispenser of claim 3, wherein the sealing membranes conform to the shape of the pill so that the pill is unable to move between the membranes.

5. The pill dispenser of claim 3, wherein any space between the portions of the membranes surrounding a pill not occupied by the pill itself, is filled with an inert gas that will not chemically react with the pill.

6. The pill dispenser of claim 3, wherein the sealing membranes and pills form a continuous pill pack comprising a plurality of pills which are individually sandwiched between the sealing membranes at prescribed separation distances from adjacent pills, said prescribed separation distances corresponding to the separation distances between pill chambers of the pill carrier.

7. The pill dispenser of claim 6, wherein the pill carrier has an upper portion and a lower portion, and wherein the upper and lower portions of the pill carrier are separable from one another to the extent necessary to allow the pill pack to be inserted between or removed from the upper and lower pill carrier portions.

8. The pill dispenser of claim 7, wherein the upper and lower portions of the pill carrier are rotatively joined together along one side by at least one hinge, such that the portions are rotatable in relation to each other about the hinged side to insert a pill pack and thereafter rotated back into a closed position.

9. The pill dispenser of claim 1, wherein the integrated plunger apparatus comprises a cantilevered arm connected to the body of the dispenser housing on only one side, namely a side corresponding to the proximal end of the cantilevered arm.

10. The pill dispenser of claim 9, wherein the cantilevered arm of the plunger apparatus is connected to the body of the dispenser housing via living hinge.

11. The pill dispenser of claim 9, wherein the pill carrier further comprises first and second sealing membranes overlying and underlying a pill in each pill chamber respectively so as to seal the pill from the outside environment, and wherein the length of the punch head in the direction of its extension into a pill chamber is limited to that which will cause the distal end of the punch head to contact the first membrane and push the pill through the second sealing membrane without tearing free any part of the first or second membrane whenever the punch head is fully extended into the pill chamber.

12. The pill dispenser of claim 1, further comprising a locking mechanism capable of releasably locking the pill carrier in a full retracted position within the dispenser housing, said fully retracted position corresponding to a position wherein all the pill chambers are covered by the dispenser housing.

13. The pill dispenser of claim 12, wherein the locking mechanism comprises a projection extending into the pill carrier slot from the wall of the slot, said projection being capable of extending into and retracting from an indentation formed in the exterior surface of the pill carrier whenever in alignment therewith, thereby causing the pill carrier to be releasably held in said fully retracted position.

14. The pill dispenser of claim 13, wherein the locking mechanism's projection retracts from the indentation when a prescribed amount of longitudinally directed force is applied to the pill carrier by the user.

15. The pill dispenser of claim 12, wherein the locking mechanism comprises an indentation formed in the wall of the pill carrier slot and a projection extending from the exterior surface of the pill carrier, said projection being capable of extending into and retracting from the indentation whenever in alignment therewith, thereby causing the pill carrier to be releasably held in said fully retracted position.

16. The pill dispenser of claim 15, wherein the locking mechanism's projection retracts from the indentation when a prescribed amount of longitudinally directed force is applied to the pill carrier by the user.

17. The pill dispenser of claim 1, further comprising an indexing mechanism capable of aligning each pill chamber of the pill carrier in sequence to the punch head and dispenser housing opening.

18. The pill dispenser of claim 17, wherein the indexing mechanism comprises a projection extending from the wall of the pill carrier slot, said projection being capable of respectively extending into and retracting from each of a series of indentations formed in the exterior surface of the pill carrier whenever in alignment therewith, thereby causing the pill carrier to be releasably held at one of plural index locations with respect to the dispenser housing, said index locations each corresponding to a position wherein one of the pill chambers of the pill carrier is in alignment with the punch head and dispenser housing opening.

19. The pill dispenser of claim 18, wherein the indexing mechanism's projection retracts from a pill carrier indentation when a prescribed amount of longitudinally directed force is applied to the pill carrier by the user.

20. The pill dispenser of claim 17, wherein the indexing mechanism comprises an indentation formed in the wall of the pill carrier slot and a series of projections extending from the exterior surface of the pill carrier, said projections being capable of respectively extending into and retracting from the indentation whenever in alignment therewith, thereby causing the pill carrier to be releasably held at one of plural index locations with respect to the dispenser housing, said index locations each corresponding to a position wherein one of the pill chambers of the pill carrier is in alignment with the punch head and dispenser housing opening.

21. The pill dispenser of claim 20, wherein the indexing mechanism's projections retract from the pill carrier indentation when a prescribed amount of longitudinally directed force is applied to the pill carrier by the user.

22. A pill dispenser comprising:

a pill carrier comprising, a plurality of through-holes forming pill chambers, each pill chamber at least initially holding a pill which is sealed from the outside environment and contained within the pill chamber, a plurality of integrated plungers, each of which forms a top covering of a respective one of the pill chambers, said plungers capable of dispensing a pill contained within the pill chamber, and a dispenser housing comprising a pill carrier slot capable of enclosing a portion of the pill carrier containing the pill chambers, said pill carrier being displaceable within said pill carrier slot to allow the sequentially exposure of each of said pill chambers.

23. The pill dispenser of claim 22, wherein each plunger comprises a projection extending into its associated pill chamber and capable of pushing a pill contained within the pill chamber out of the bottom of the pill chamber whenever the plu nger apparatus is actuated by a user.

24. The pill dispenser of claim 23, wherein the pill carrier further comprises first and second sealing membranes overlying and underlying a pill in each pill chamber respectively, and wherein the length of the plunger projection in the direction of its extension into a pill chamber is limited to that which will cause the distal end of the projection to contact the first membrane and push the pill through the second sealing membrane without tearing free any part of the first or second membrane whenever the projection is fully extended into the pill chamber during actuation of the plunger by the user.

25. The pill dispenser of claim 22, wherein each plunger is joined at its periphery to the wal the pill chamber, said plunger eing made of a material and having a thickness at its peripheral region which causes the joint between the plunger and the wall of the pill chamber to be flexible, thereby allowing a user to actuate a plunger by depressing the top of that plunger.

26. The pill dispenser of claim 22, wherein each plunger is held in a retracted position while a pill is residing in the pill chamber, but once depressed by a user in order to dispense the pill, the plunger remains in a depressed position to provide an indication to the user that the pill chamber is empty.

27. The pill dispenser of claim 22, wherein a lateral cross-section of the dispenser housing has peripheral shape approximating an oval with a flattened side corresponding to the bottom of the pill dispenser, said flattened bottom of the pill dispenser preventing it from rolling when laid on that side.

28. The pill dispenser of claim 22, wherein a pill held within a pill chamber of the pill carrier is sandwiched between two sealing membranes capable of sealing the pill from the outside environment and suspending the pill by these membranes from the wall of the pill chamber.

29. The pill dispenser of claim 28, wherein the sealing membranes conform to the shape of the pill so that the pill is unable to move between the membranes.

30. The pill dispenser of claim 28, wherein any space between the portions of the membranes surrounding a pill not occupied by the pill itself, is filled with an inert gas that will not chemically react with the pill.

31. The pill dispenser of claim 28, wherein the sealing membranes and pills form a continuous pill pack comprising a plurality of pills which are individually sandwiched between the sealing membranes at prescribed separation distances from adjacent pills, said prescribed separation distances corresponding to the separation distances between pill chambers of the pill carrier.

32. The pill dispenser of claim 31, wherein the pill carrier has an upper portion and a lower portion, and wherein the upper and lower portions of the pill carrier are separable from one another to the extent necessary to allow the pill pack to be inserted between or removed from the upper and lower pill carrier portions.

33. The pill dispenser of claim 32, wherein the upper and lower portions of the pill carrier are rotatively joined together along one side by at least one hinge, such that the portions are rotatable in relation to each other about the hinged side to insert a pill pack and thereafter rotated back into a closed position.

34. The pill dispenser of claim 22, further comprising a locking mechanism capable of releasably locking the pill carrier in a full retracted position within the dispenser housing, said fully retracted position corresponding to a position wherein all the pill chambers are covered by the dispenser housing.

35. The pill dispenser of claim 34, wherein the locking mechanism comprises a projection extending into the pill carrier slot from the wall of the slot, said projection being capable of extending into and retracting from an indentation formed in the exterior surface of the pill carrier whenever in alignment therewith, thereby causing the pill carrier to be releasably held in said fully retracted position.

36. The pill dispenser of claim 35, wherein the locking mechanism's projection retracts from the indentation when a prescribed amount of longitudinally directed force is applied to the pill carrier by the user.

37. The pill dispenser of claim 34, wherein the locking mechanism comprises an indentation formed in the wall of the pill carrier slot and a projection extending from the exterior surface of the pill carrier, said projection being capable of extending into and retracting from the indentation whenever in alignment therewith, thereby causing the pill carrier to be releasably held in said fully retracted position.

38. The pill dispenser of claim 37, wherein the locking mechanism's projection retracts from the indentation when a prescribed amount of longitudinally directed force is applied to the pill carrier by the user.

39. A pill dispenser comprising:

a pill carrier comprising, a plurality of through-holes forming pill chambers, each pill chamber at least initially holding a pill which is sealed from the outside environment and contained within the pill chamber, and a plurality of integrated plungers, each of which forms a top covering of a respective one of the pill chambers, said plungers capable of dispensing a pill contained within the pill chamber, and wherein each plunger comprises a projection extending into its associated pill chamber and capable of pushing a pill contained within the pill chamber out of the bottom of the pill chamber whenever the plunger is actuated by a user.

40. The pill dispenser of claim 39, wherein the pill carrier further comprises first and second sealing membranes overlying and underlying a pill in each pill chamber respectively, and wherein the length of the plunger projection in the direction of its extension into a pill chamber is limited to that which will cause the distal end of the projection to contact the first membrane and push the pill through the second sealing membrane without tearing free any part of the first or second membrane whenever the projection is fully extended into the pill chamber during actuation of the plunger by the user.

41. A pill dispenser comprising:

a pill carrier comprising, a plurality of through-holes forming pill chambers, each pill chamber at least initially holding a pill which is sealed from the outside environment and contained within the pill chamber, and a plurality of integrated plungers, each of which forms a top covering of a respective one of the pill chambers, said plungers capable of dispensing a pill contained within the pill chamber, and wherein each plunger is joined along its entire periphery to the wall of the pill chamber, said plunger being made of a material and having a thickness at its peripheral region which causes the interface between the plunger and the wall of the pill chamber to be flexible, thereby allowing a user to actuate a plunger by depressing the top of that plunger.

42. A pill dispenser comprising:

a pill carrier comprising, a plurality of through-holes forming pill chambers, each pill chamber at least initially holding a pill which is sealed from the outside environment and contained within the pill chamber, and a plurality of integrated plungers, each of which forms a top covering of a respective one of the pill chambers, said plungers capable of dispensing a pill contained within the pill chamber, and wherein each plunger is held in a retracted position while a pill is residing in the pill chamber, but once depressed by a user in order to dispense the pill, the plunger remains in a depressed position to provide an indication to the user that the pill chamber is empty.

43. A pill dispenser comprising:

a pill carrier comprising, a plurality of through-holes forming pill chambers, each pill chamber at least initially holding a pill which is sealed from the outside environment and contained within the pill chamber, and a plurality of integrated plungers, each of which forms a top covering of a respective one of the pill chambers, said plungers capable of dispensing a pill contained within the pill chamber, and wherein a pill held within a pill chamber of the pill carrier is sandwiched between two sealing membranes capable of sealing the pill from the outside environment and suspending the pill by these membranes from the wall of the pill chamber.

44. The pill dispenser of claim 43, wherein the sealing membranes conform to the shape of the pill so that the pill is unable to move between the membranes.

45. The pill dispenser of claim 43, wherein any space between the portions of the membranes surrounding a pill not occupied by the pill itself, is filled with an inert gas that will not chemically react with the pill.

46. The pill dispenser of claim 43, wherein the sealing membranes and pills form a continuous pill pack comprising a plurality of pills which are individually sandwiched between the sealing membranes at prescribed separation distances from adjacent pills, said prescribed separation distances corresponding to the separation distances between pill chambers of the pill carrier.

47. The pill dispenser of claim 46, wherein the pill carrier has an upper portion and a lower portion, and wherein the upper and lower portions of the pill carrier are separable from one another to the extent necessary to allow the pill pack to be inserted between or removed from the upper and lower pill carrier portions.

48. The pill dispenser of claim 47, wherein the upper and lower portions of the pill carrier are rotatively joined together along one side by at least one hinge, such that the portions are rotatable in relation to each other about the hinged side to insert a pill pack and thereafter rotated back into a closed position.

* * * * *